US006343817B1

(12) United States Patent
Watanabe

(10) Patent No.: US 6,343,817 B1
(45) Date of Patent: Feb. 5, 2002

(54) VEHICLE DOOR LATCH DEVICE WITH DOUBLE ACTION MECHANISM

(75) Inventor: Hirofumi Watanabe, Yamanashi-ken (JP)

(73) Assignee: Mitsui Kinzoku Kogyo Kabushiki Kaisha, Toyko (JP)

( * ) Notice: Subject to any disclaimer, the term of this patent is extended or adjusted under 35 U.S.C. 154(b) by 0 days.

(21) Appl. No.: 09/553,850

(22) Filed: Apr. 20, 2000

(30) Foreign Application Priority Data

Apr. 21, 1999 (JP) ..... 11-113642

(51) Int. Cl.[7] ..... E05C 3/06

(52) U.S. Cl. ..... 292/216; 292/201; 292/DIG. 23; 292/DIG. 65

(58) Field of Search ..... 292/144, 198, 292/201, 216, 336.3, DIG. 23, DIG. 46, DIG. 65

(56) References Cited

U.S. PATENT DOCUMENTS 5,653,484 A * 8/1997 Brackmann et al. ..... 292/216

FOREIGN PATENT DOCUMENTS

DE 4313248 C2 * 10/1996

* cited by examiner

*Primary Examiner*—Robert Oberleitner
*Assistant Examiner*—Thomas J. Williams
(74) *Attorney, Agent, or Firm*—Browdy and Neimark

(57) ABSTRACT

A vehicle door latch device has a double action mechanism (27) comprising a release lever (61) for opening the door, an inner lever (55) connected to an inside open handle (28), and a slide link (64). The slide link is displaced between a connective position for connecting the inner lever to the release lever and a non-connective position for disconnecting the inner lever from the release lever. The inner lever has a push arm (57) which transmits an unlocking movement of the inner lever to the lock lever without engagement with the slide link, and a blocking surface (59) which restrict a displacement of the slide link from the non-connective position to the connective position during the unlocking movement of the inner lever.

5 Claims, 13 Drawing Sheets

5
6
3
10
9
2
13
7
12
15
16
19
4
18
17
11
2
14
8
1
INTERIOR SIDE
EXTERIOR SIDE

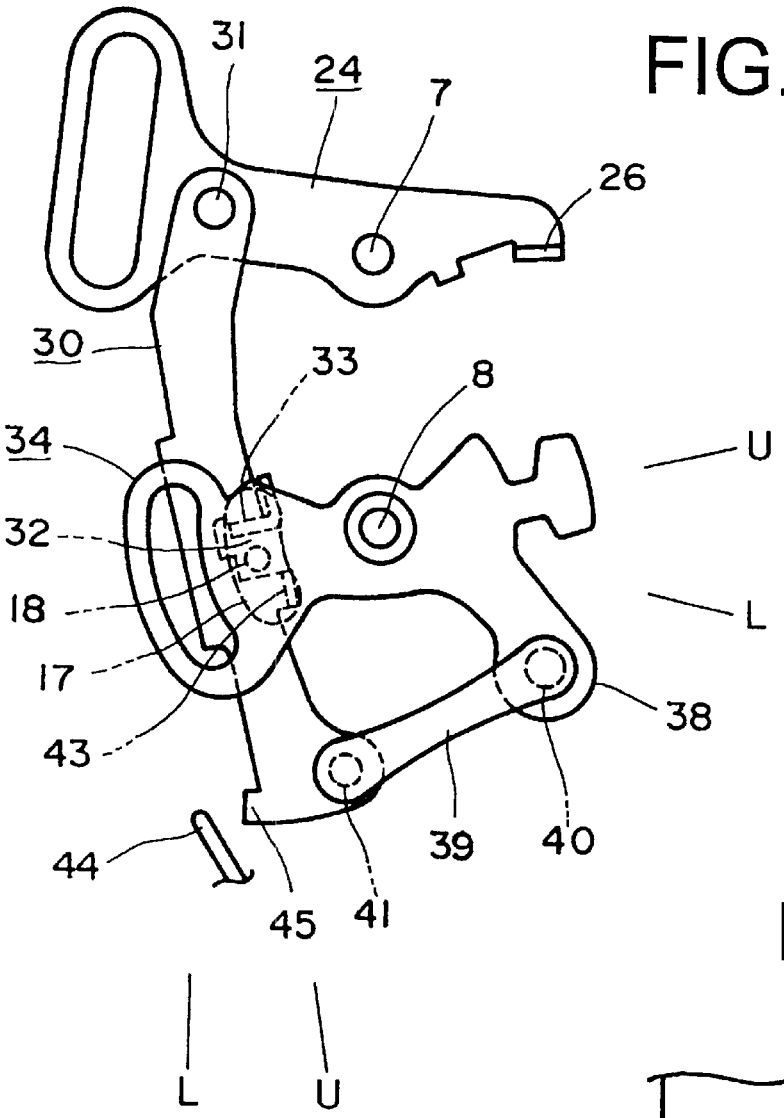
FIG. 5
FIG. 6
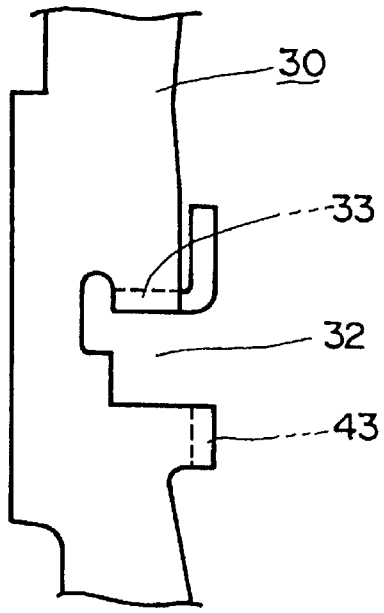

VEHICLE DOOR LATCH DEVICE WITH DOUBLE ACTION MECHANISM

TECHNICAL FIELD

The present invention relates to a vehicle door latch device, and more particularly, to a vehicle door latch device with a double action mechanism.

BACKGROUND OF THE INVENTION

Previously, a double action mechanism (hereafter DA mechanism) has been provided in a door latch device for the purpose of improving the performance of crime prevention of the door latch device. It can be said that the DA mechanism is an improved mechanism of a previously well-known one-motion door opening mechanism. The conventional one-motion mechanism is approximately simultaneously capable of restoring the latch device from a locked state to an unlocked state and opening the door, when an inside open handle of the door is operated in a case where the door latch device is in the locked state.

On the contrary, the DA mechanism merely restores the latch device from the locked state to the unlocked state without opening the door, when the opening operation of the inside open handle is performed in the locked state. The DA mechanism opens the door in accordance with the door-opening actuation of the inside open handle only when the latch device is in the unlocked state. Accordingly, in order to open the locked door having a latch device with a DA mechanism by the inside handle, both a first door-opening actuation of the inside handle for restoring the latch device to the unlocked state from the locked state and a second door-opening actuation of the inside handle for releasing the latch device are necessary. Thus, the DA mechanism requires the double action of the inside open handle when opening the door, so that it can improve the performance of crime prevention of the door latch device.

The German Patent DE 4313248 C2 discloses a door latch device with a DA mechanism. This door latch device comprises an open lever (4) connected to an outside open handle of a vehicle door and arranged to open the door when the outside open handle is operated, and a lock lever (6) displaceable between an unlocked position where it makes a door-opening operation of the open lever effective and a locked position where it makes the door-opening operation of the open lever ineffective.

The German Patent door latch device further comprises an inner lever (5) connected to an inside open handle of the door, a release lever (9) relevantly provided between the inner lever (5) and the open lever (4) for actuating the open lever (4) when rotated, and an elongated slide link or connective member (14) relevantly provided between the inner lever (5) and the release lever (9). The inner lever (5) is arranged to perform an unlocking movement from its initial position (FIGS. 2, 4) to its open position (FIGS. 3, 5) by a first door-opening actuation of the inside open handle at the time when the lock lever (6) is in the locked position, and is arranged to perform an opening movement from the initial position to the open position by a second door-opening actuation of the inside open handle at the time when the lock lever (6) is in the unlocked position. The slide link (14) is displaceable between a connective position where it mechanically connects the inner lever (5) to the release lever (9) and a non-connective position where it disconnects the release lever (9) from the inner lever (5).

The slide link (14) has one end operatively connected to the lock lever (6), and is held at the non-connective position when the lock lever (6) is in the locked position. The slide link (14) is urged toward the connective position from the non-connective position by the elasticity of a spring (18). In the locked state of FIG. 2, when the unlocking movement of the inner lever (5) is performed by the first door-opening actuation of the inside open handle, the slide link (14) moves up to be displaced to the connective position as shown in FIG. 3 by the engagement between a part (15) of the inner lever (5) and a part (16) of the slide link (14), and consequently, the lock lever (6) is shifted to the unlocked position, but the release lever (9) does not turn.

When the inside open handle is released after the first door-opening actuation, the inner lever (5) is restored to the initial position as shown in FIG. 4. At this moment, the slide link (14) is once moved down toward the non-connective position by the contact with a part (11) of the inner lever (5), and after that, it is restored again to the connective position by the elasticity of the spring (18). In the unlocked state of FIG. 4, when the inner lever (5) is turned in the door-opening direction by the second door-opening actuation of the inside handle, the release lever (9) turns to operate the open lever (4), and the door is opened.

The above German Patent device has a problem in that the unlocking movement of the inner lever (5) by the first door-opening actuation of the inside handle is transmitted to the lock lever (6) through the slide link (14). This structure causes the slide link (14) to move against the elasticity of the spring (18) when the inner lever (5) returns to the initial position after the first door-opening actuation. This movement of the slide link (14) prevents the smooth restoration of the inner lever (5) to the initial position, and consequently, the feeling of quality of the device is lowered.

SUMMARY OF THE INVENTION

Accordingly, it is an object of the present invention to provide a vehicle door latch device with a double action mechanism which overcomes the above-mentioned problem. In order to attain this object, the present invention employs a structure where the unlocking movement of the inner lever by the first door-opening actuation of the inside open handle is substantially transmitted to the lock lever in direct.

BRIEF DESCRIPTION OF THE DRAWINGS

FIG. 5 is a segmentary rear view of the latch assembly in which an open link is lowered by an open lever in FIG. 4;

FIG. 6 is a partially enlarged view of the open link;

DETAILED DESCRIPTION OF THE PREFERRED EMBODIMENTS

Figure 1:
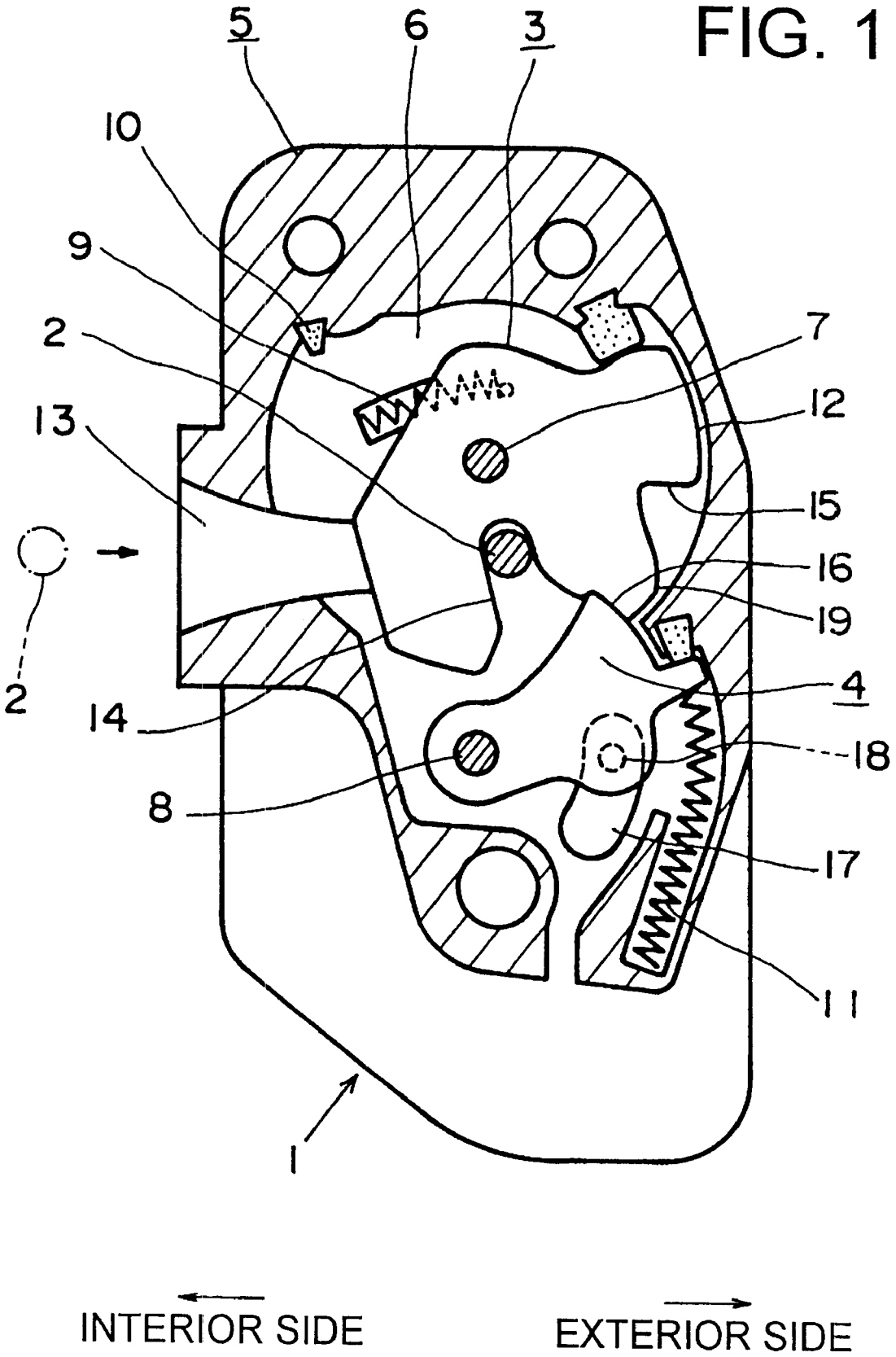
FIG. 1 is a front view of a latch assembly of a vehicle door latch device according to the present invention.

In the accompanied drawings, there are three embodiments of a vehicle door latch device in accordance with the present invention. The first embodiment which is shown in FIGS. 1 to 14 has a double action mechanism as a fundamental function. The second embodiment shown in FIGS. 15 to 24 is additionally provided with an anti-theft mechanism as an optional function in addition to the fundamental function of the first embodiment. The third embodiment shown in FIG. 25 has a childlock mechanism in addition to the fundamental function of the first embodiment.

Referring now to FIGS. 1 to 14, the vehicle door latch device of the first embodiment comprises a latch assembly 1 which is attached to a vehicle door (not shown), and a striker 2 which is fixed to a vehicle body (not shown). The latch assembly 1 comprises a latch 3 which is engaged with the striker 2 when the door is closed, and a ratchet 4 which holds the engagement of the latch 3 and the striker 2. The latch 3 is rotatably received by a latch shaft 7 in an upper portion of a concave portion 6 formed in a front surface of a synthetic resin latch body 5, and the ratchet 4 is rotatably received by a ratchet shaft 8 in a lower portion of the concave portion 6.

The latch 3 is urged in the clockwise direction in FIG. 1 by a spring force of a latch spring 9. When the door is in an open position, the latch 3 is located in an unlatched position and is brought into contact with a damper 10 on the latch body 5 by the spring force of the spring 9. The ratchet 4 is urged in the counterclockwise direction by a spring force of a ratchet spring 11. The ratchet 4 is brought into contact with an unlatching portion 12 of the latch 3 when the door is in the open position. When the door moves from the open position toward a full-closed position, the striker 2 enters a horizontal passage 13 formed in the latch body 5 to be brought into contact with a U-shaped groove 14 of the latch 3, thereby the latch 3 turns counterclockwise against the spring force of the latch spring 9. When the latch 3 turns from the unlatched position to a half-latched position, the ratchet 4 is engaged with a first step 15 of the latch 3 and the door reaches a half-close position. Furthermore, when the latch 3 reaches a full-latched position shown in FIG. 1, the ratchet 4 is engaged with a second step 16 of the latch 3 and the door is held in the full-close position.

Figure 2:
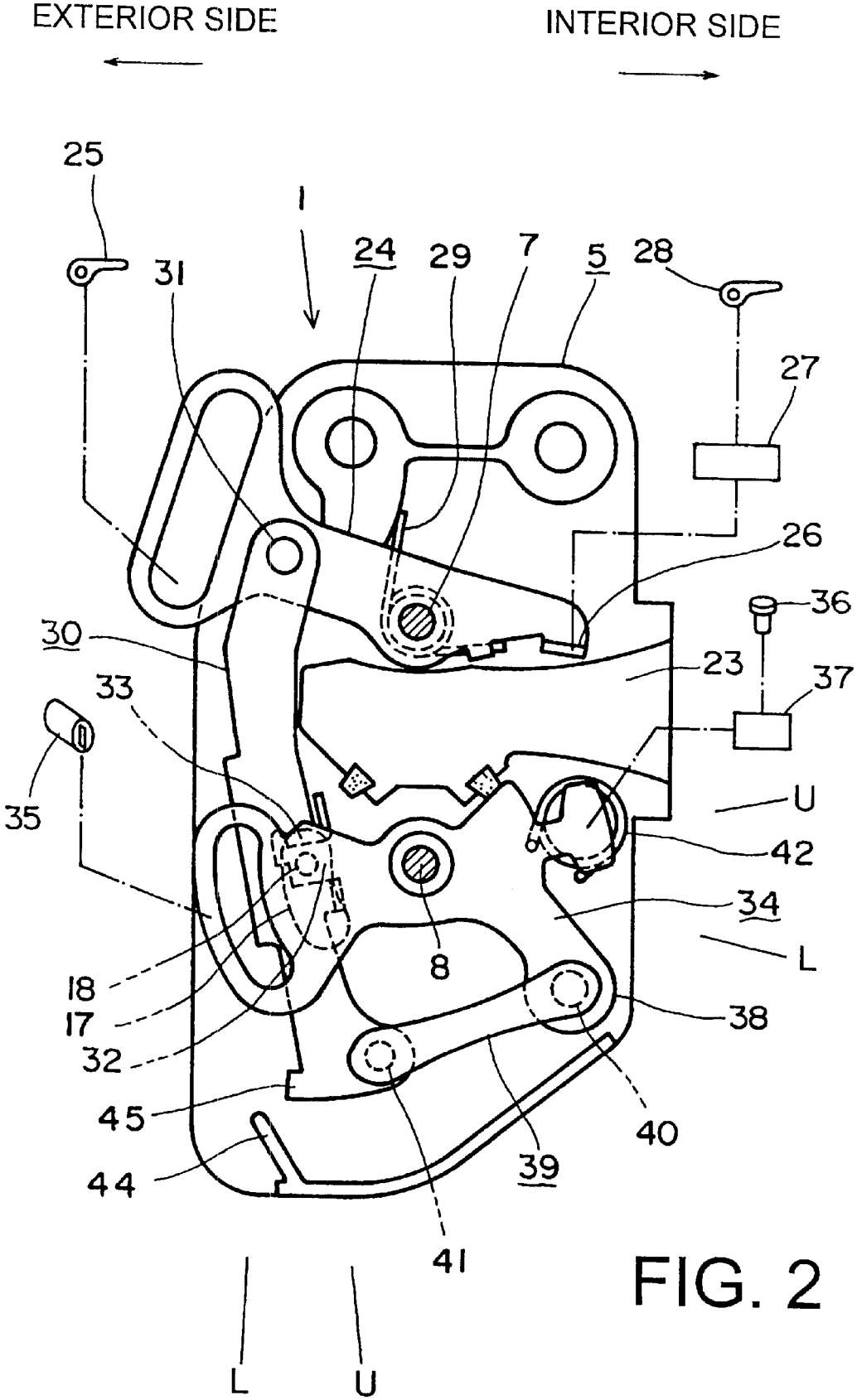
FIG. 2 is a rear view of the latch assembly in an unlocked state.
Figure 3:
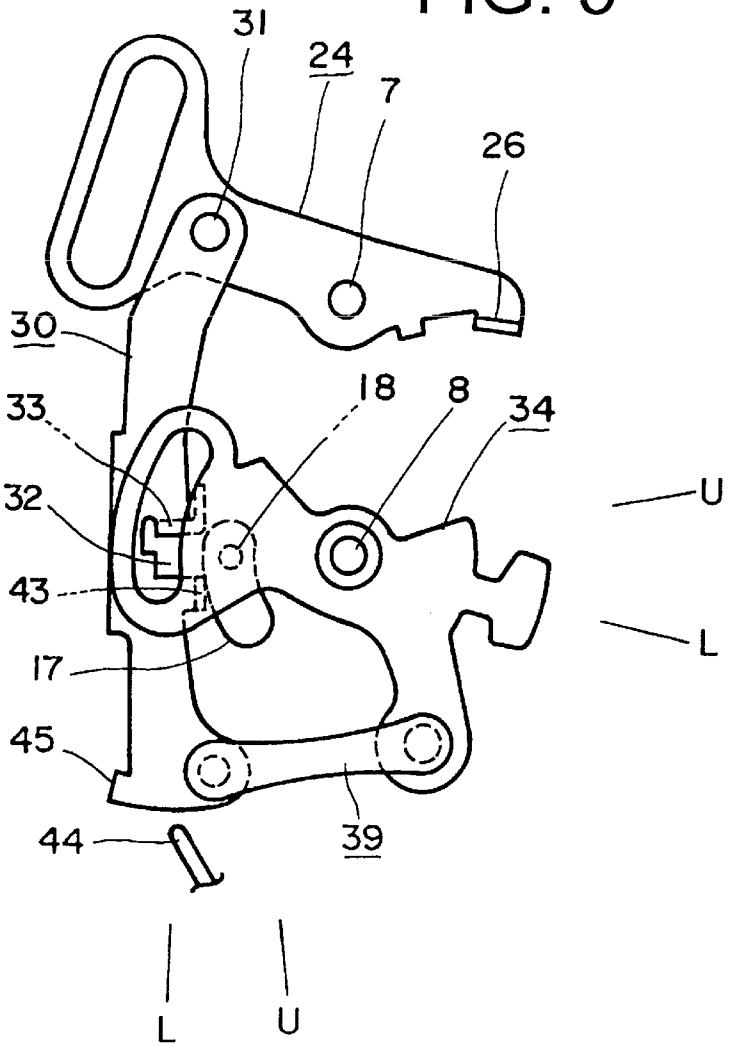
FIG. 3 is a segmentary rear view of the latch assembly in a locked state.
Figure 4:
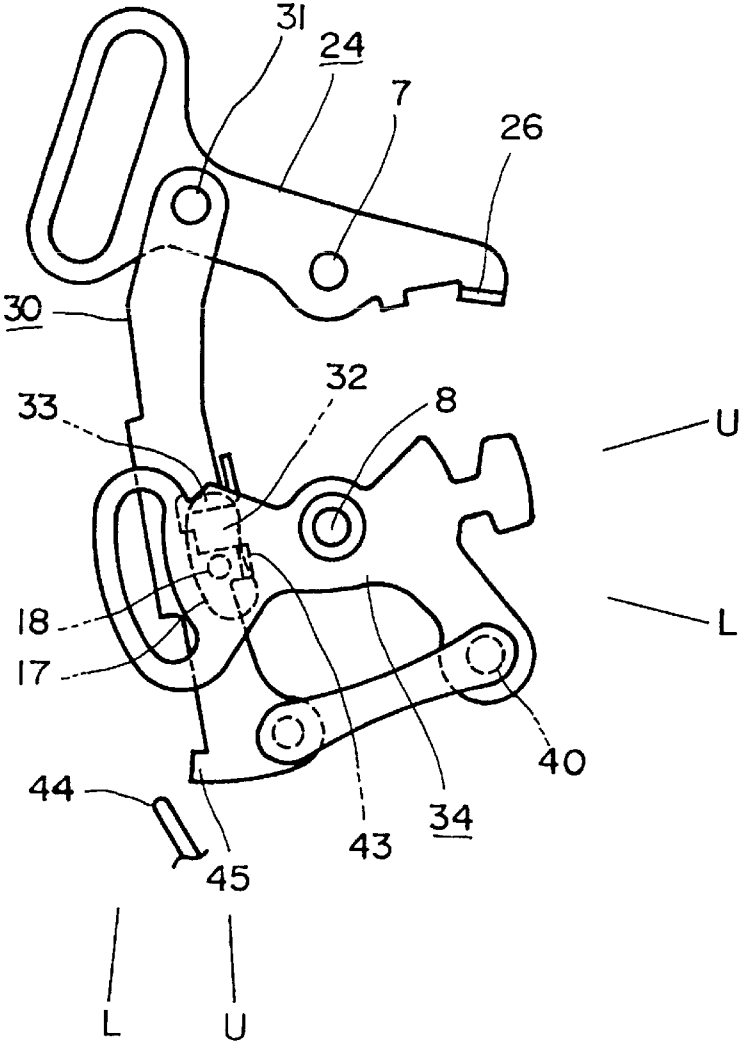
FIG. 4 is a segmentary rear view of the latch assembly in the unlocked and a door-opening states.

The ratchet 4 has a ratchet pin 18 which projects onto the rear side of the latch body 5 through an opening 17 of the latch body 5. The ratchet pin 18 is positioned at the upper portion within the opening 17 as shown in FIGS. 1 to 3 when the door is in the close position, that is, when the ratchet 4 is brought into contact with or engaged with one of the first and second steps 15, 16. When the door is in the open position, that is, when the ratchet 4 is brought into contact with the unlatching portion 12, the pin 18 is positioned at the lower portion within the opening 17 as shown in FIGS. 4 and 5). Furthermore, the pin 18 is also positioned at the lower portion of the opening 17 when the ratchet 4 is brought into contact with a large diameter portion 19 formed between the first step 15 and the second step 16.

Figure 7:
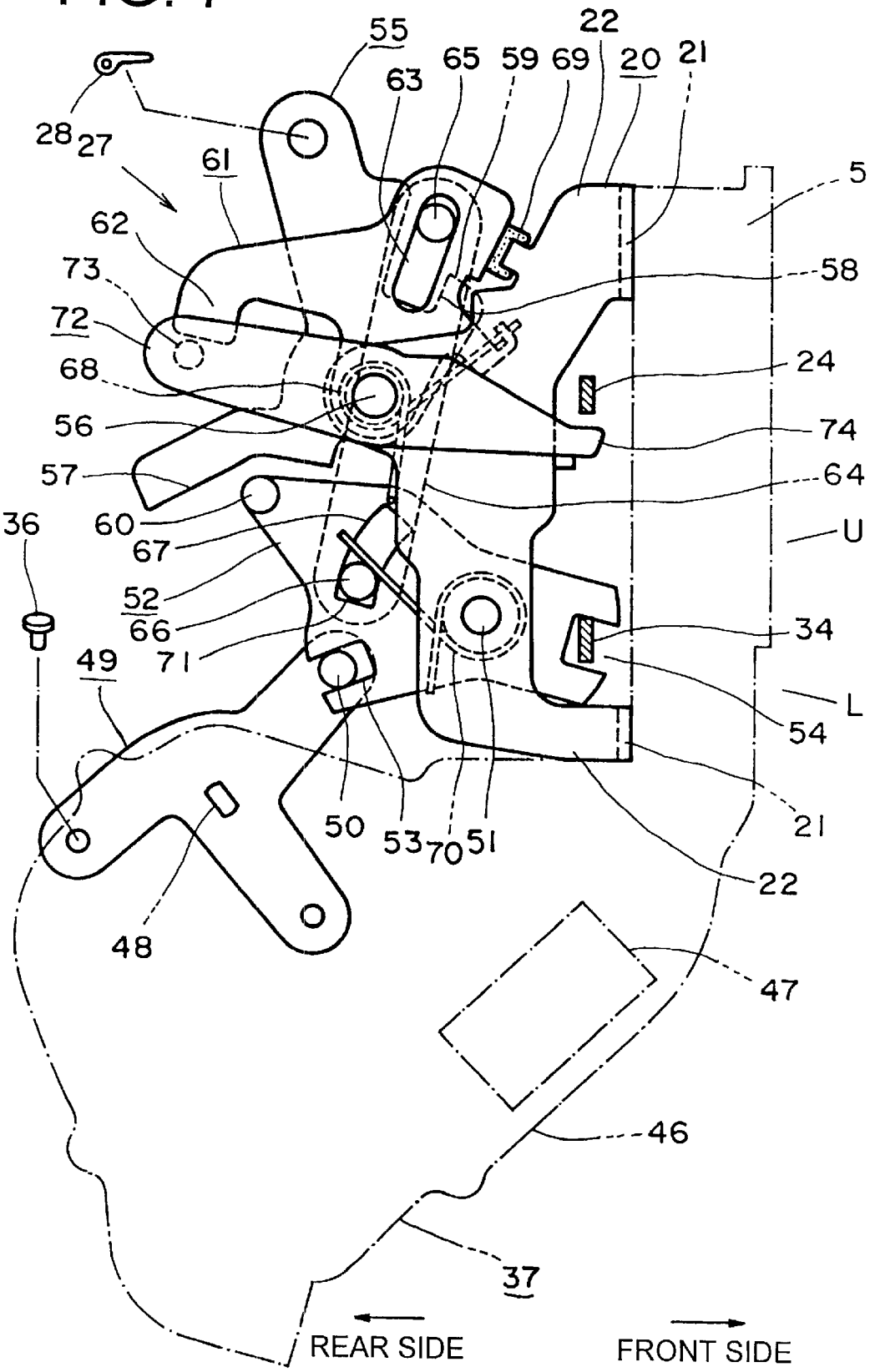
FIG. 7 is a side view of the latch assembly in the locked state.

To the rear portion of the latch body 5, as shown in FIG. 7, a metal back plate 20 is attached. The back plate 20 comprises a parallel plate 21 which is substantially in parallel with the rear surface of the latch body 5, and a bent plate 22 which is angled to extend rearward from the interior side edge of the parallel plate 21. The rear side of the latch body 5 is formed with a horizontal bulge portion 23 (FIG. 2) which projects rearward from the rear of the latch body 5. The horizontal passage 13 is defined by the space on the front side of the horizontal bulge portion 23.

As shown in FIG. 2, at the rear side of the latch body 5 above the horizontal bulge portion 23, an open lever 24 is rotatably attached by the latch shaft 7. An outside open handle 25 of the door is connected to the exterior side portion of the open lever 24. The interior side portion of the open lever 24 is formed with a contact portion 26 which is operatively connected to an inside open handle 28 of the door through a double action mechanism 27 (hereafter DA mechanism 27) described later. The open lever 24 is urged in the clockwise direction in FIG. 2 by a spring force of a spring 29, and is turned counterclockwise by the opening actuation of the open handles 25, 28. An upper end of a vertically extending elongated open link 30 is connected to the exterior side portion of the open lever 24 by a pin 31. The open link 30 is positioned on the exterior side with respect to the horizontal bulge portion 23 so that the open link 30 does not overlap with the horizontal bulge portion 23 in the back-and-forth direction of the latch body 5. In the middle portion of the open link 30, a notch portion 32 (FIG. 6) is formed. The upper edge of the notch portion 32 is formed with a horizontal contact surface 33 which is angled toward the latch body 5.

At the rear side of the latch body 5 below the horizontal bulge portion 23, a lock lever 34 is rotatably attached by the ratchet shaft 8. The lock lever 34 has an exterior side end which is connected to a key cylinder 35 of the door, and an interior side end which is connected to an inside lock button 36 of the door through a motorized actuator unit 37. The lock lever 34 has a diagonally downward extending arm 38 which is connected to a right end of an approximately horizontal connecting link 39 by a pin 40. A left end of the connecting link 39 is connected to the lower end of the open link 30 by a pin 41.

The lock lever 34 is displaceable between an unlocked position U shown in FIG. 2 and a locked position L shown in FIG. 3 around the ratchet shaft 8 as a center by the actuation of one of the key cylinder 35, the lock button 36, and the motorized actuator unit 37. This displacement of the lock lever 34 makes the lower portion of the open link 30 move left and right around the pin 31 as a center, and the open link 30 is similarly displaced between the unlocked position U and the locked position L. However, it is only when the door is closed that the lock lever 34 (open link 30) can be displaced from the unlocked position U to the locked position L, which is to be described later. The lock lever 34 (the open link 30) is held by a spring force of an over-center spring 42 at one of the unlocked position U and the locked position L with respect to the dead point of the spring 42 as a boundary.

When the open link 30 is located at the unlocked position U as shown in FIG. 2, the horizontal contact surface 33 formed on the notch portion 32 is engageably opposed to the ratchet pin 18 in the vertical direction. Accordingly, the horizontal contact surface 33 is brought into contact with the ratchet pin 18 to turn the ratchet 4 clockwise in FIG. 1 against the spring force of the ratchet spring 11 when the open link 30 is lowered by the actuation of the open lever 24, thereby the latch 3 is released from the restriction by the ratchet 4 so as to open the door.

When the open link 30 is shifted to the locked position L by the locking actuation of the lock lever 34, the horizontal contact surface 33 moves to the side of the ratchet pin 18, as shown in FIG. 3, thereby the engageable state therebetween is cancelled. Accordingly, in the locked state of FIG. 3, the door cannot be opened even if the open link 30 is lowered.

The open link 30 has a vertical contact surface 43 (FIG. 5) which is connected to the under surface of the notch portion 32 and is angled toward the latch body 5. The latch body 5 has, at the lower portion thereof, a block member 44 which is projected rearward from the latch body 5 as one piece. The vertical contact surface 43 and the block member 44 restrict the displacement of the lock lever 34 (open link 30) from the unlocked position U to the locked position L when the door is in the open position. That is, in the door-open state of the FIG. 4, the vertical contact surface 43 is positioned at the interior side of the ratchet pin 18 which is located at the lower portion of the opening 17 due to the engagement of the ratchet 4 with the unlatching portion 12 of the latch 3, and therefore, the displacement of the open link 30 from the unlocked position U to the locked position L is restricted by the engagement between the vertical contact surface 43 and the ratchet pin 18. It is noted that the engageable state between the vertical contact surface 43 and the ratchet pin 18 can be cancelled as shown in FIG. 5 if the open link 30 is moved downward in FIG. 4 by the actuation of the open handles 25, 28. However, if the open link 30 is lowered, a lower end 45 of the open link 30 is engageably opposed to the interior side of the block member 44 newly, thereby the displacement of the open link 30 to the locked position L is restricted. Accordingly, when the door is in the open position, it is impossible to shift the door latch device to the locked state.

As shown in FIG. 7, the actuator unit 37 is attached to the latch body 5 or the back plate 20. The actuator unit 37 has an output shaft 48 which is outwardly projected from an actuator case 46 and which is rotated by the power of a built-in motor 47. The output shaft 48 supports a rotary lever 49 which has one end connected to the inside lock button 36 and the other end formed with a projection 50.

Onto the bent plate 22 of the back plate 20, an operating lever 52 (FIG. 11) is pivoted by a support shaft 51 which extends in the left-and-right direction of the latch body 5. A hook 53 of the operating lever 52 is engaged with the projection 50 of the rotary lever 49, and a forked portion 54 at the lower portion of the operating lever 52 is engaged with the interior side end of the lock lever 34. Therefore, the operating lever 52 and the lock lever 34 are displaced between the unlocked position U and the locked position L as one piece against the elasticity of the over-center spring 42 when the rotary lever 49 is turned by the actuation of the built-in motor 47 or the inside lock button 36.

The double action mechanism 27 is attached to the bent plate 22, as shown in FIG. 7, and is operatively provided between the inside open handle 28 and the open lever 24. The DA mechanism 27 turns the open lever 24 to open the door when the inside handle 28 is operated while the lock lever 34 is located in the unlocked position U. However, if the inside handle 28 is operated to open the door while the lock lever 34 is located in the locked position L, the DA mechanism 27 does not open the door, but it shifts the lock lever 34 from the locked position L to the unlocked position U. That is, the DA mechanism 27 restores the lock lever 34 (inside lock button 36) to the unlocked position U by the first door-opening actuation of the inside open handle 28, and by the second door-opening actuation of the inside handle 28, DA mechanism opens the door. The double action consisting of the first and second door-opening actuations required by the DA mechanism 27 improves the anti-theft performance of the door latch device.

The structure of the DA mechanism 27 will be described in detail. The DA mechanism 27 has an inner lever 55 (FIG. 12) which is pivoted to the bent plate 22 by a mounting shaft 56 in parallel with the support shaft 51 and which is connected to the inside open handle 28. When the inside handle 28 is not operated, the inner lever 55 is held at its initial position or rest position shown in FIG. 7 by a spring (not shown) provided at the inside handle 28. The inner lever 55 has a push arm 57, a hook 58, and a blocking surface 59 communicating with one end of the hook 58. The push arm 57 is engageably opposed to an engaging projection 60 of the operating lever 52 positioned in the locked position L. The arm 57 is brought into contact with the engaging projection 60 to turn the operating lever 52 in the counter-clockwise (unlocking) direction so as to displace the lock lever 34 from the locked position L to the unlocked position U when the inner lever 55 is turned counterclockwise.

Onto the mounting shaft 56, a release lever 61 (FIG. 13) is pivoted such that it may overlap with the inner lever 55. The release lever 61 is urged in the clockwise direction in FIG. 7 by a spring 68, and is usually brought into contact with a stopper 69 attached to the bent plate 22. The release lever 61 has a contact arm 62, and an elongated hole 63 which partially overlaps with the hook 58 and which extends in the radial direction of the mounting shaft 56. A slide pin 65 is slidably engaged with the elongated hole 63. The slide pin 65 is formed at an upper end of a slide link 64 (FIG. 14) which extends in the vertical or up-and-down direction of the latch body 5. The slide link 64 has, at the lower end thereof, a connecting pin 66 which is slidably engaged with a circular arc slot 67 formed on the operating lever 52 around the support shaft 51 as a center. Between the slide link 64 and the operating lever 52, a spring 70 for urging the slide link 64 downward is provided. The spring 70 has a first leg engaged with connecting pin 66 and a second leg engaged with the operating lever 52.

In the locked state of FIG. 7, the connecting pin 66 of the slide link 64 is brought into contact with a lower end 71 of the circular arc slot 67 by the elasticity of the spring 70, and the slide pin 65 is positioned at the upper portion in the elongated hole 63 of the release lever 61 and is disengaged from the hook 58 of the inner lever 55 so as not to transmit the rotational movement of the inner lever 55 to the release lever 61. This position of the slide link 64 where the slide pin 65 is disengaged from the hook 58, is called a non-connective position.

Figure 8:
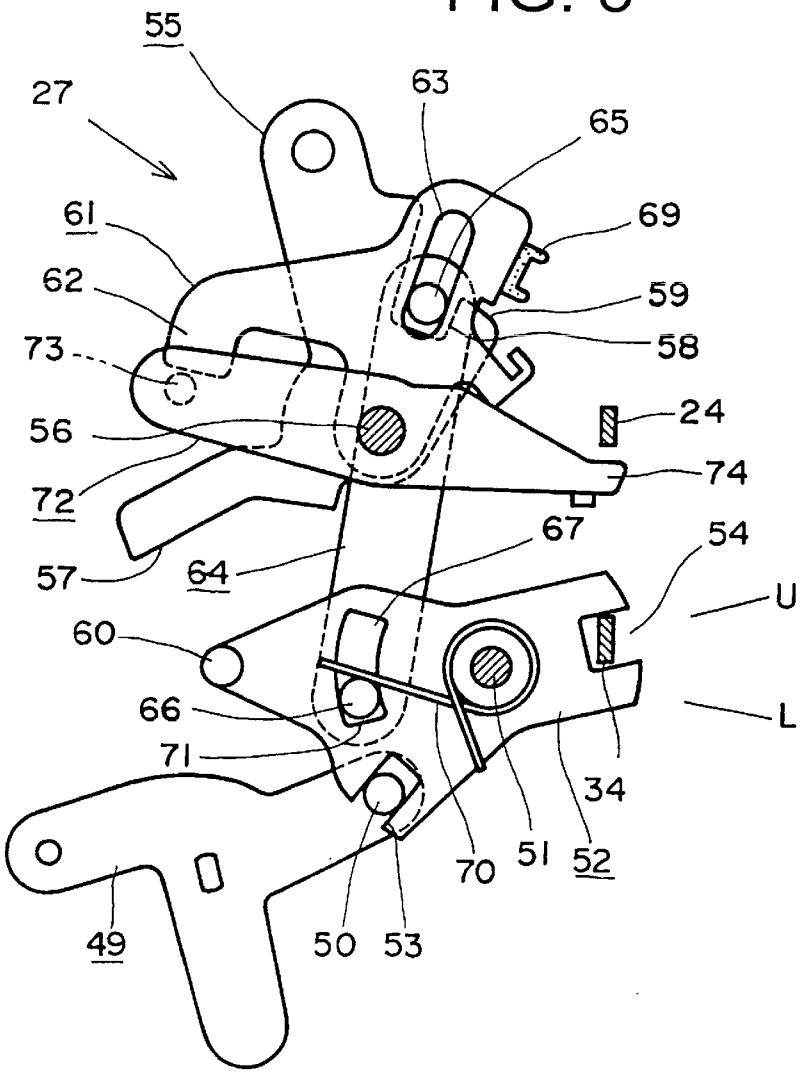
FIG. 8 is a segmentary side view of the latch assembly in the unlocked state.

In the locked state of FIG. 7, when unlocking the lock lever 34 by using the key cylinder 35, the operating lever 52 is turned in the counterclockwise (unlocking) direction in FIG. 7 through the lock lever 34 and is displaced to the unlocked position U as shown in FIG. 8. In addition, since the connecting pin 66 is pressed against the lower end 71 of the slot 67 of the operating lever 52 by the spring force of the spring 70, the slide link 64 is moved downward, following the unlocking movement of the operating lever 52, and the slide pin 65 is engaged with the hook 58 of the inner lever 55 so as to transmit the rotational movement of the inner lever 55 to the release lever 61. This position of the slide link 64 where the slide pin 65 is engaged with the hook 58, is called a connective position.

To the mounting shaft 56, a sub lever 72 is also pivoted. The sub lever 72 has at one end thereof a sub projection 73 which is engageable with the contact arm 62 of the release lever 61, and an engaging portion 74 at the other end thereof which is engageably opposed to the interior side end of the open lever 24. When the release lever 61 is turned counterclockwise, the contact arm 62 of the release lever 61 is brought into contact with the sub projection 73 of the sub lever 72 to turn the sub lever 72 counterclockwise. Then, the engaging portion 74 at the lower portion of the sub lever 72 is brought into contact with the interior side end of the open lever 24 and turns the open lever 24 so as to open the door.

Figure 25:
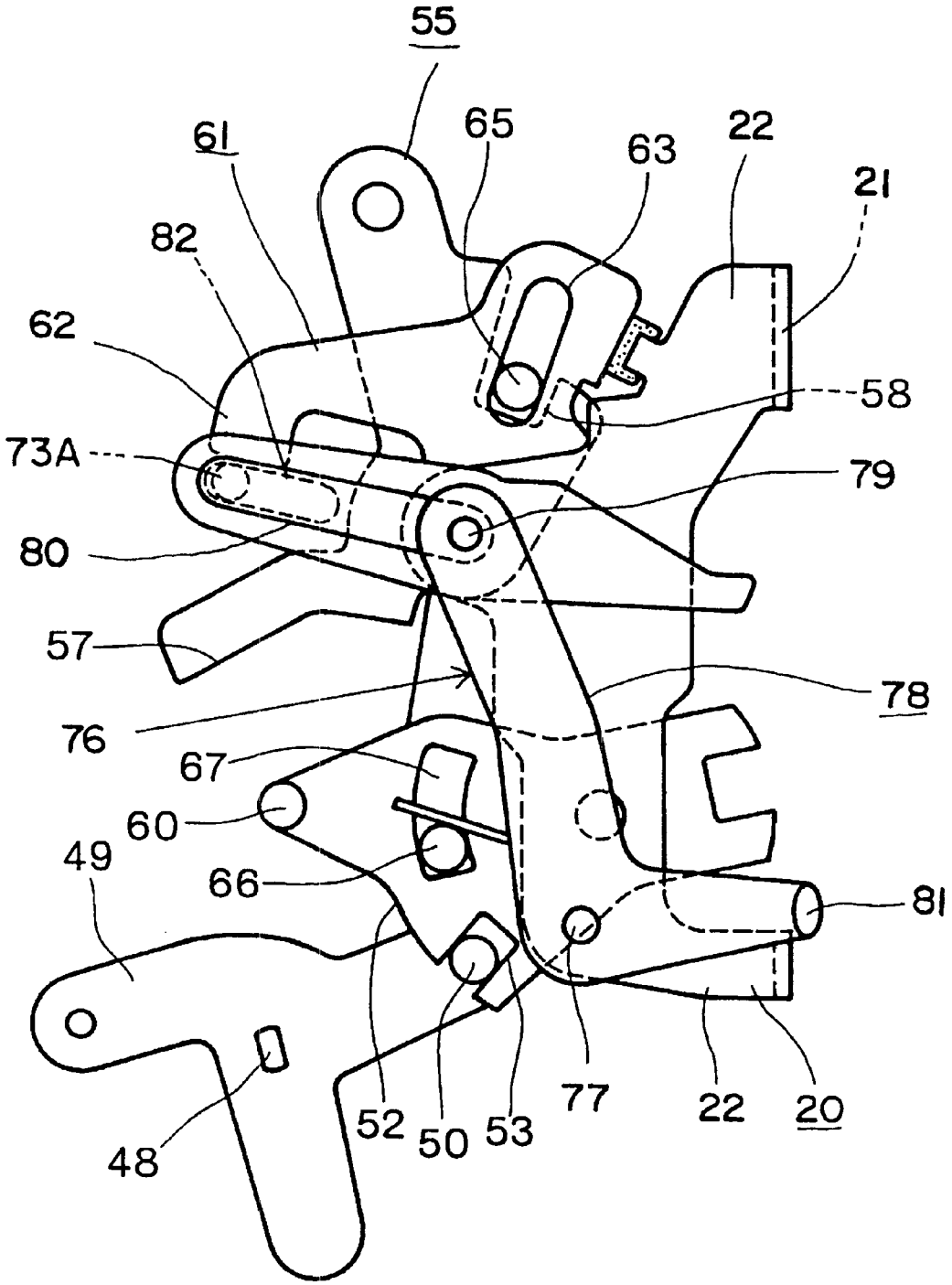
FIG. 25 is a segmentary side view of a latch assembly of the third embodiment of the present invention, which is provided with a child-lock mechanism.

Between the sub lever 72 and the release lever 61, a well known child-lock mechanism 76 may be provided as shown in FIG. 25, if desired. It should be noted that the sub lever 72 could be integrally formed with the release lever 61 as one-piece when the child-lock mechanism 76 is not necessary.

Figure 9:
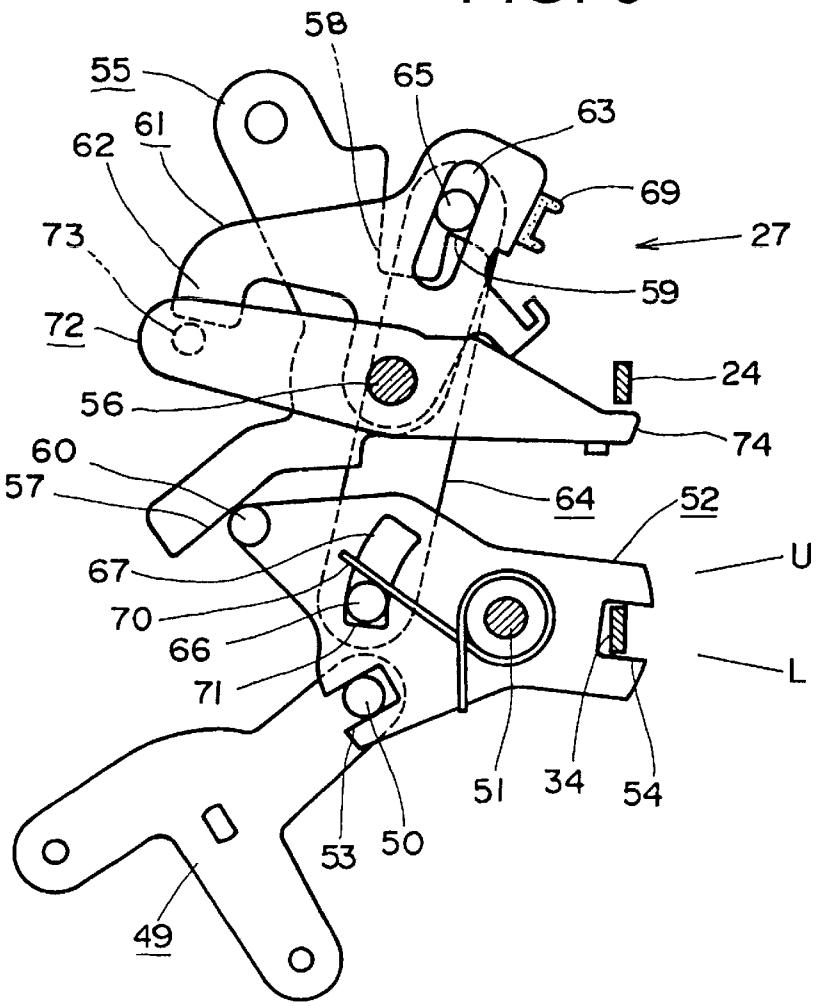
FIG. 9 is a segmentary side view of the latch assembly in which an inner lever is slightly rotated in a door-opening direction by a first door-opening actuation of an inside open handle in FIG. 7.

The operation of the DA mechanism 27 of the first embodiment will now be explained. In the locked state of FIG. 7, even if turning the inner lever 55 counterclockwise by the first door-opening actuation of the inside handle 28, the release lever 61 is not turned due to the disengagement of the slide pin 65 from the hook 58. Instead of that, by the rotational movement of the inner lever 55, the blocking surface 59 of the inner lever 55 is shifted to overlap with the elongated hole 63, and the push arm 57 of the inner lever 55 is brought into contact with the engaging projection 60 of the operating lever 52 to gradually turn the operating lever 52 counterclockwise. Thereby the lock lever 34 is gradually displaced toward the unlocked position U from the locked position L by the engagement between the forked portion 54 of the operating lever 52 and the interior side end of the lock lever 34 against the elasticity of the over-center spring 42, and the slide pin 65 of the slide link 64 which is moved downward together with the operating lever 52 is brought into contact with the blocking surface 59 of the inner lever 55, as shown in FIG. 9. It is noted that, in the state of FIG. 9, the lock lever 34 has not yet been exceeded the dead point of the over-center spring 42 so that the lock lever 34 and the operating lever 52 are still urged by the elasticity of the over-center spring 42 toward the locked position L. Therefore the lock lever 34, the slide pin 65 and so on are returned to the initial positions thereof shown in FIG. 7 if the first door-opening actuation of the inside handle 28 is interrupted in the state of FIG. 9.

Figure 10:
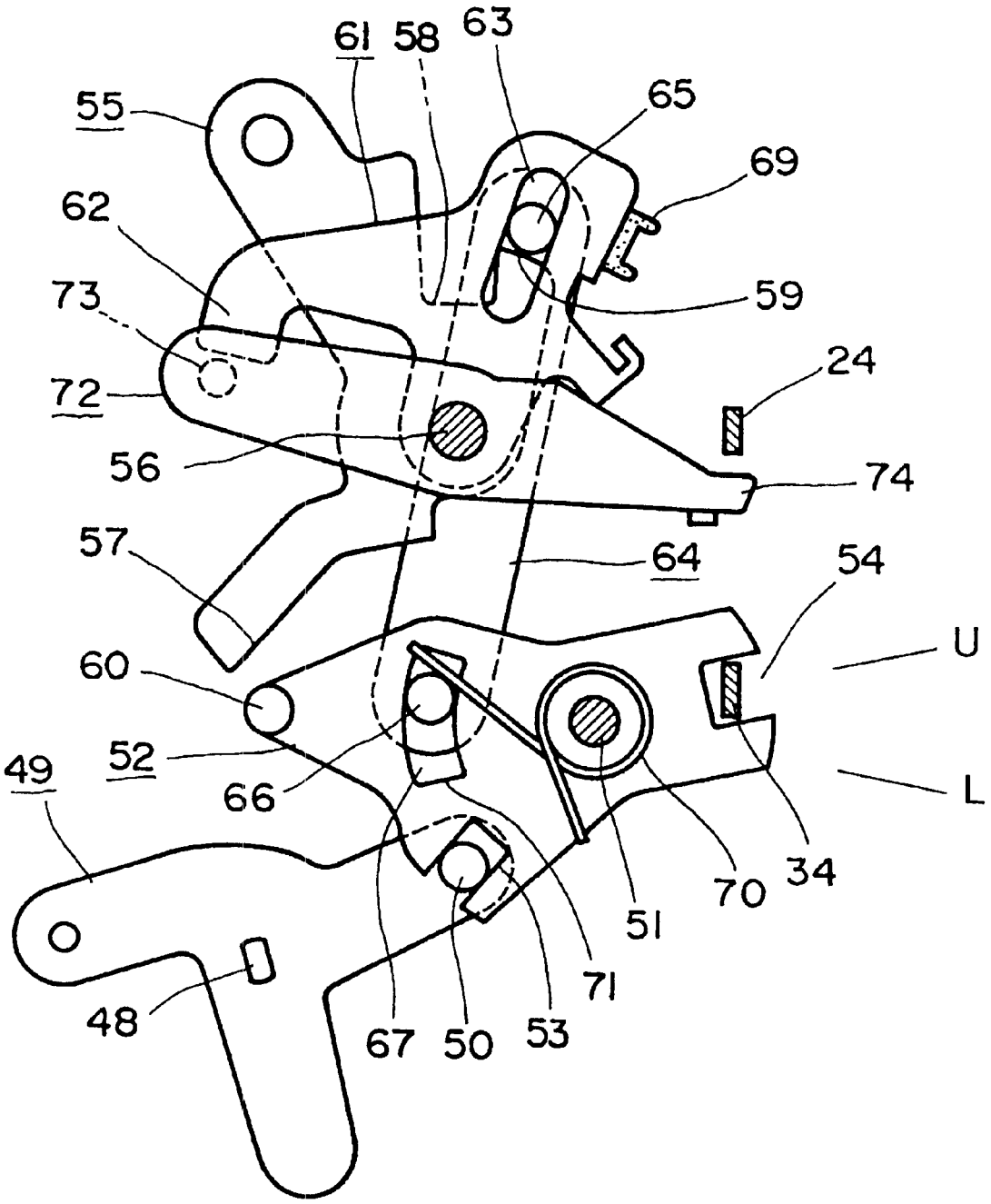
FIG. 10 is a segmentary side view of the latch assembly in which the inner lever is completely rotated in the door-opening direction in FIG. 9.
Figure 11:
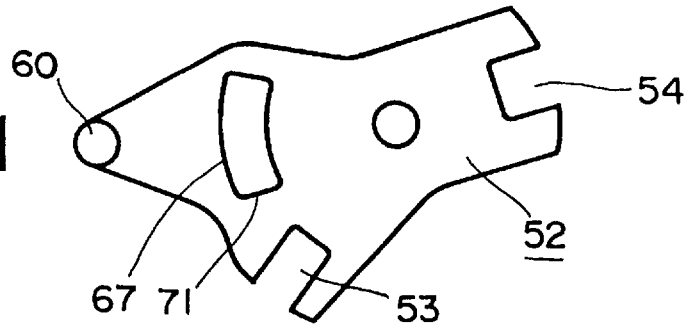
FIG. 11 is a side view of an operating lever of the latch assembly.
Figure 14:
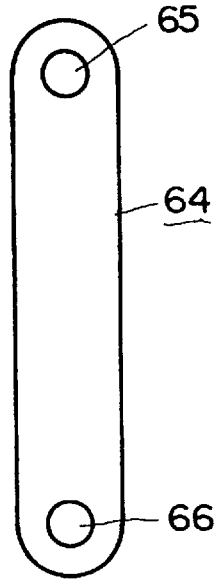
FIG. 14 is a side view of a slide link of the latch assembly.
Figure 12:
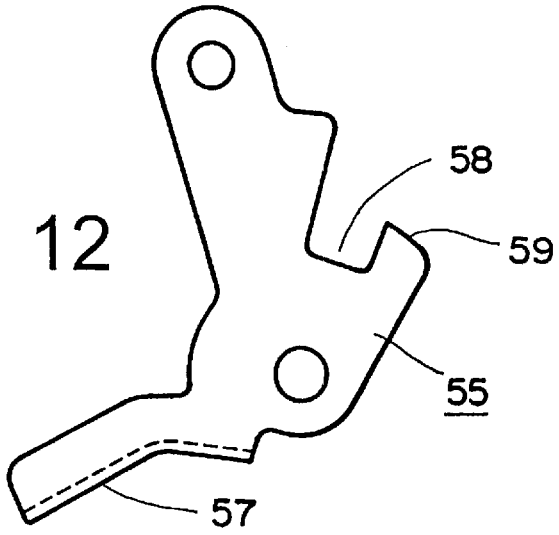
FIG. 12 is a side view of the inner lever of the latch assembly.
Figure 13:
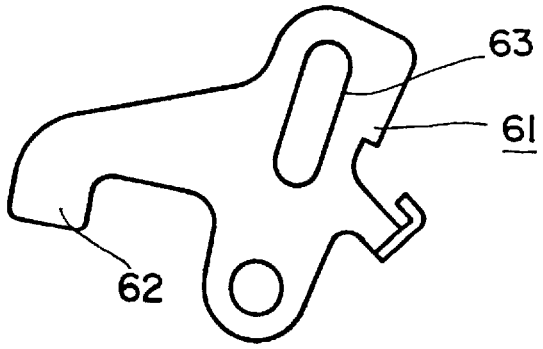
FIG. 13 is a side view of a release lever of the latch assembly.

In the state of FIG. 9, when further turning the inner lever 55 counterclockwise by the first door-opening actuation of the inside handle 28, the operating lever 52 is pressed by the push arm 57 and the lock lever 34 is displaced to the unlocked position U as shown in FIG. 10, but the slide pin 65 is still in contact with the blocking surface 59. The above rotational movement of the inner lever 55 by the first door-opening actuation is called an unlocking movement.

In the state of FIG. 10 where the locked state is released, when interrupting the first door-opening actuation of the inside handle 28 and restoring the inside handle 28 to the initial position, the inner lever 55 is turned clockwise, and the slide pin 65 is then released from the restriction by the blocking surface 59, and thereby the pin 65 moves downward by the elasticity of the spring 70 and enters the hook 58 as shown in FIG. 8. At this moment, the spring 70 is only elastically expanded, but it is not compressed.

In the unlocked state of FIG. 8, when turning the inner lever 55 counterclockwise by the second door-opening actuation of the inside open handle 28, the release lever 61 is also turned counterclockwise by the engagement between the slide pin 65 and the hook 58 of the inner lever 55, and thereby the contact arm 62 of the release lever 61 is brought into contact with the sub projection 73 of the sub lever 72 to turn the sub lever 72 counterclockwise. Then, the engaging portion 74 at the lower portion of the sub lever 72 is brought into contact with the interior side end of the open lever 24 and turns the open lever 24 so as to open the door. The above rotational movement of the inner lever 55 by the second door-opening actuation is called an opening movement against the unlocking movement of the inner lever 55 in the locked state.

Next, the second embodiment of the door latch device which is additionally provided with an anti-theft mechanism as an optional function in addition to the DA mechanism as a fundamental function of the first embodiment will be described by using FIGS. 15 to 24.

Figure 15:
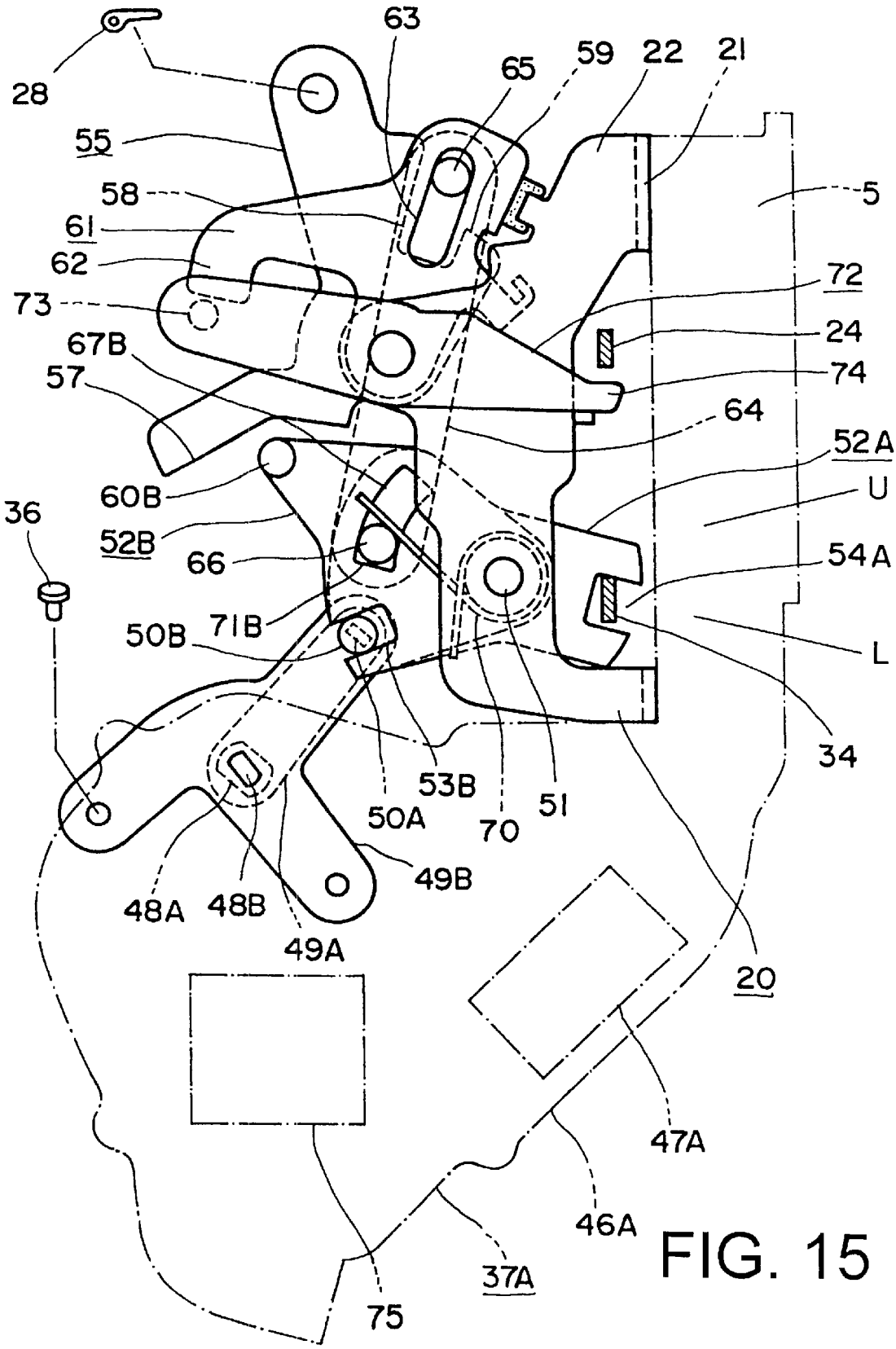
FIG. 15 is a side view of a latch assembly in a locked state in accordance with the second embodiment of the present invention, which is provided with an anti-theft mechanism.

In FIG. 15, an anti-theft mechanism 75 is provided in the motorized actuator unit 37A which is attached to the latch body 5 or the back plate 20. The actuator unit 37A has a key side shaft (output shaft) 48A and a lock button side shaft 48B, both of which project to the outside from an actuator case 46A. The key side shaft 48A supports a key side lever 49A (FIG. 20) which has a key side projection 50A at the tip end thereof. The button side shaft 48B supports a lock button side lever 49B (FIG. 21) which has one end connected to the inside lock button 36 and the other end formed with a projection 50B.

A member corresponding to the operating lever 52 of the first embodiment shown in FIG. 7 is divided into two pieces consisting of a key side operating lever 52A (FIG. 22) and a lock button side operating lever 52B (FIG. 23), and both of which are pivoted by the support shaft 51. A key side hook 53A (refer to FIG. 17) of the key side operating lever 52A is engaged with the key side projection 50A of the lever 49A, and a key side forked portion 54A of the key side operating lever 52A is engaged with the interior side of the lock lever 34. A button side hook 53B of the operating lever 52B is engaged with the button side projection 50B of the lever 49B.

An engaging projection 60B which is adapted to be brought into contact with the push arm 57 of the inner lever 55 is provided at the button side operating lever 52B. The operating levers 52A and 52B respectively have circular arc slots 67A and 67B with which the connecting pin 66 of the slide link 64 is slidably engaged. Usually, the operating levers 52A, 52B are in a relation in which the circular arc slots 67A, 67B overlap with each other.

Figure 24:
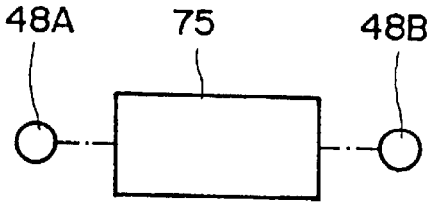
FIG. 24 is a schematic view describing an anti-theft mechanism of the second embodiment.

Although the description of the inside structure of the actuator unit 37A will be omitted, the lock lever 34 is displaced between the unlocked position U and the locked position L when the key side shaft 48A is turned by the power of the built-in motor 47A of the actuator unit. In addition, the built-in anti-theft mechanism 75 of the unit 37A is operatively provided between the shaft 48A and the shaft 48B as shown in FIG. 24, and is changed over between an anti-theft state and an anti-theft cancelled state by the motor 47A or another motor. In the anti-theft cancelled state, the key side shaft 48A and the button side shaft 48B are operatively connected with each other, and accordingly, it is possible to shift the lock lever 34 to the locked position L or the unlocked position U through the anti-theft mechanism 75 by the actuation of the inside lock button 36. But in the anti-theft state, at least the unlocking movement of the button side shaft 48B is not transmitted to the key side shaft 48A, and therefore, it is impossible to shift the lock lever 34 from the locked position L to the unlocked position U by the unlocking actuation of the inside lock button 36.

The rest composition in FIGS. 15 to 19 is the same as the composition shown in FIGS. 7 to 14.

Figure 16:
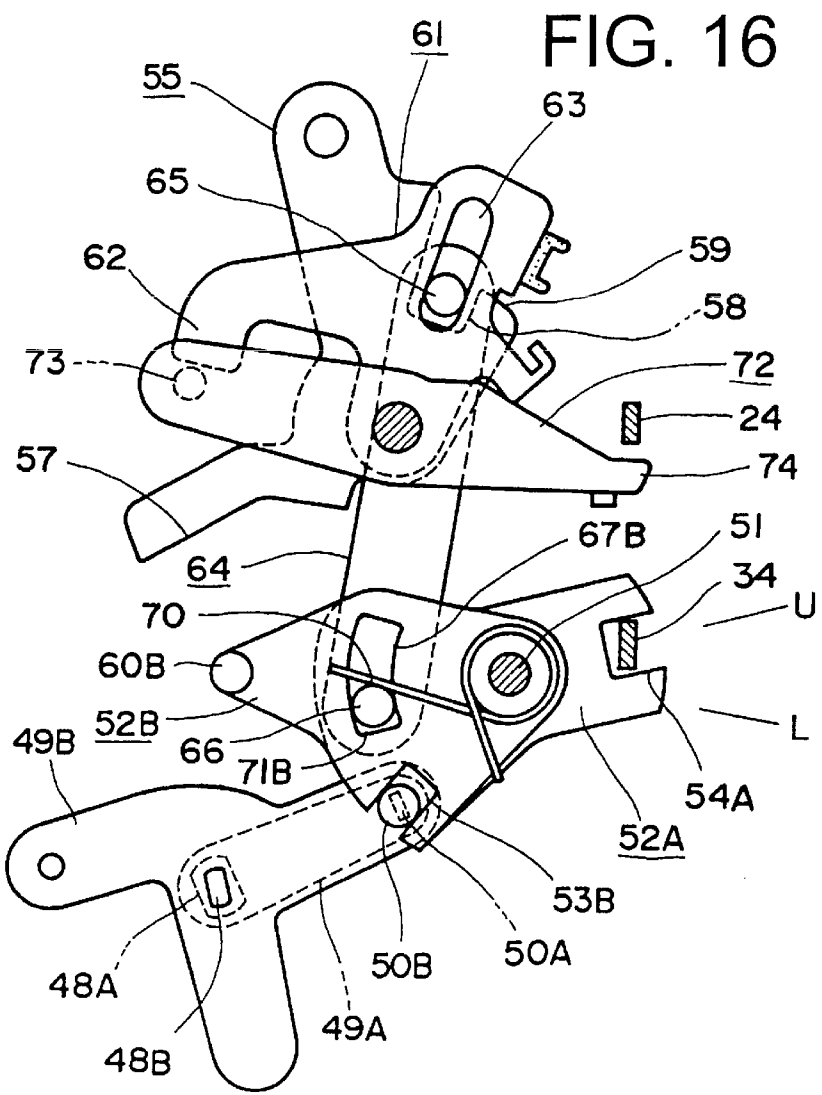
FIG. 16 is a segmentary side view of the latch assembly in an unlocked state of the second embodiment.

The operation of the second embodiment will now be explained. In the state of FIG. 15 where the lock lever 34 is located in the locked position L, the connecting pin 66 of the slide link 64 is brought into contact with the lower ends 71A, 71B of the circular arc slots 67A, 67B by the elasticity of the spring 70, and the slide pin 65 is positioned at the upper portion in the elongated hole 63 of the release lever 61 and is disengaged from the hook 58 of the inner lever 55. In this locked state, when the unlocking operation of the inside lock button 36 is performed after changing over the anti-theft mechanism 75 into the anti-theft cancelled state, the button side shaft 48B and the button side operating lever 52B are turned in the unlocking direction through the button side lever 49B, and the unlocking movement of the button side shaft 48B is then transmitted to the key side shaft 48A through the anti-theft mechanism 75. Thereby the lock lever 34 is turned in the unlocking direction through the key side lever 49A and the key side operating lever 52A so as to unlock the door latch device as shown in FIG. 16. At the same time, the slide link 64 is moved downward following both operating levers 52A, 52B by the spring force of the spring 70, and the slide pin 65 is moved to the lower portion in the elongated hole 63, whereby the slide pin 65 is engaged with the hook 58 of the inner lever 55.

Figure 17:
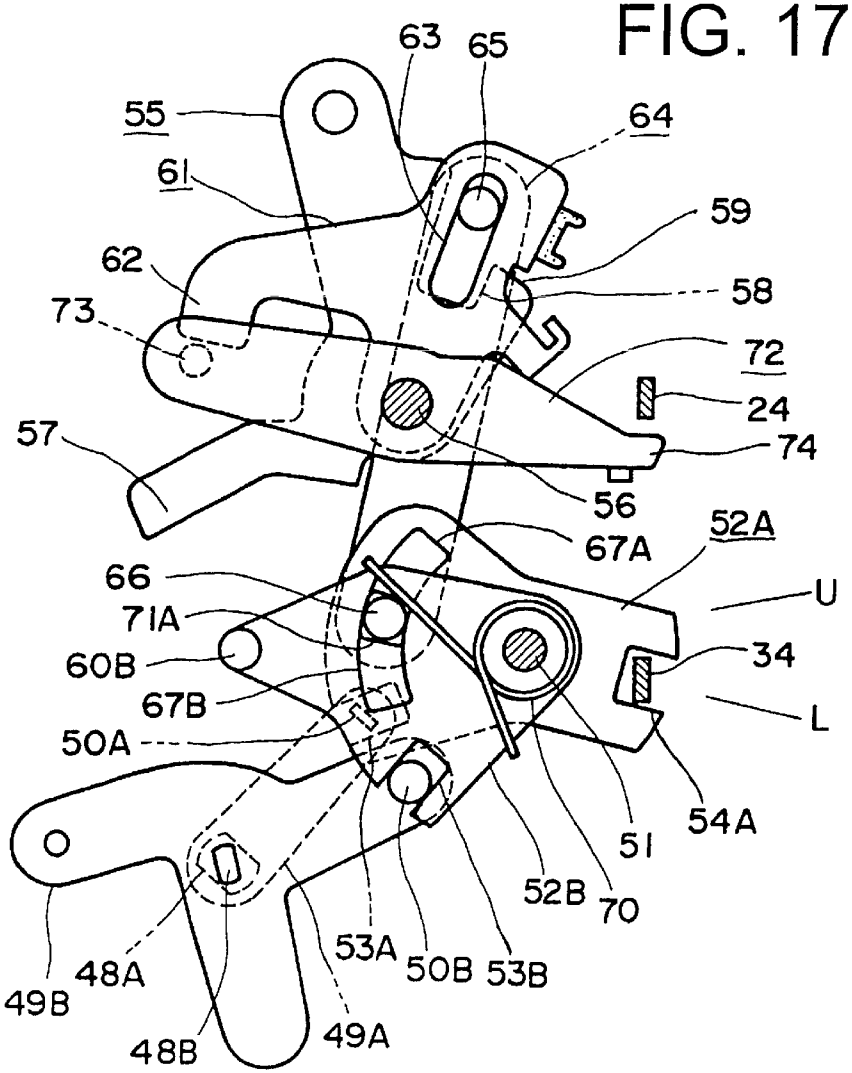
FIG. 17 is a segmentary side view of the latch assembly of the second embodiment in which a lock button side lever is rotated in an unlocking direction by an inside lock button in an anti-theft state.

On the contrary, in the locked state of FIG. 15, when the unlocking operation of the inside lock button 36 is performed after changing over the anti-theft mechanism 75 into the anti-theft state, the button side shaft 48B and the button side operating lever 52B is turned in the unlocking direction through the button side lever 49B as shown in FIG. 17, but the key side lever 49A is not turned and the lock lever 34 (key side operating lever 52A) is held at the locked position L continuously because the anti-theft mechanism 75 does not transmit the unlocking movement of the button side shaft 48B to the key side shaft 48A. Therefore, the slide link 64 is not moved downward due to the contact between the connecting pin 66 and the lower end 71A of the circular arc slot 67A of the key side operating lever 52A which is held at the locked position L, and the slide pin 65 is not engaged with the hook 58.

Figure 18:
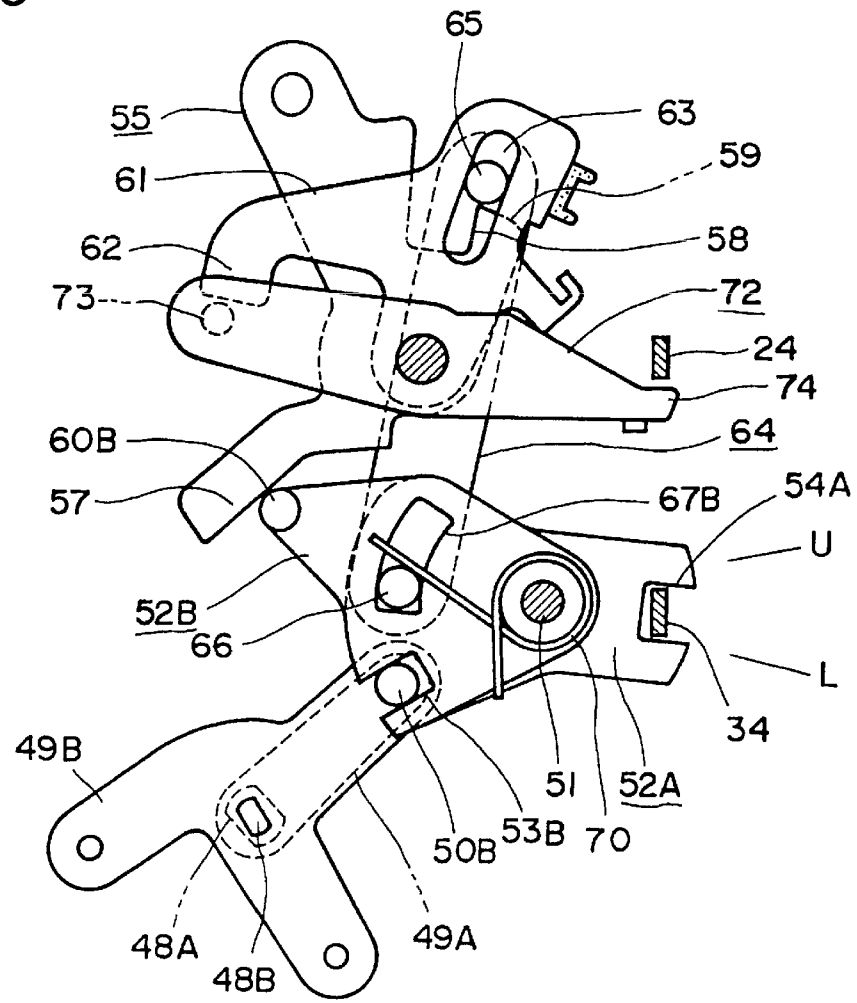
FIG. 18 is a segmentary side view of the latch assembly of the second embodiment in which the inner lever is slightly rotated in the door-opening direction by the first door-opening actuation of the inside open handle in FIG. 15.

In the locked state of FIG. 15, when turning the inner lever 55 counterclockwise by the first door-opening actuation of the inside open handle 28 after the anti-theft mechanism 75 has been shifted to the anti-theft cancelled state, the blocking surface 59 of the inner lever 55 is shifted to overlap with the elongated hole 63, and the push arm 57 of the inner lever 55 is brought into contact with the engaging projection 60B of the button side operating lever 52B to gradually turn the operating lever 52B in the unlocking direction. Then, the button side shaft 48B is turned through the button side lever 49B which is connected to the operating lever 52B, and the unlocking movement of the button side shaft 48B is transmitted to the key side shaft 48A through the anti-theft mechanism 75, and thereby the key side operating lever 52A is turned in the unlocking direction through the key side lever 49A. Consequently, the lock lever 34 is simultaneously and gradually displaced from the locked position L toward the unlocked position U against the elasticity of the over-center spring 42, and the slide pin 65 of the slide link 64 which is moved downward together with the operating levers 52A, 52B is brought into contact with the blocking surface 59 of the inner lever 55, as shown in FIG. 18. It is noted that, in the state of FIG. 18, the lock lever 34 has not yet been exceeded the dead point of the over-center spring 42 so that the lock lever 34 and the operating levers 52A, 52B are still urged by the elasticity of the over-center spring 42 toward the locked position L. Therefore the lock lever 34, the slide pin 65 and so on are returned to the initial positions thereof shown in FIG. 15 if the first door-opening operation of the inside handle 28 is interrupted in the state of FIG. 18.

Figure 19:
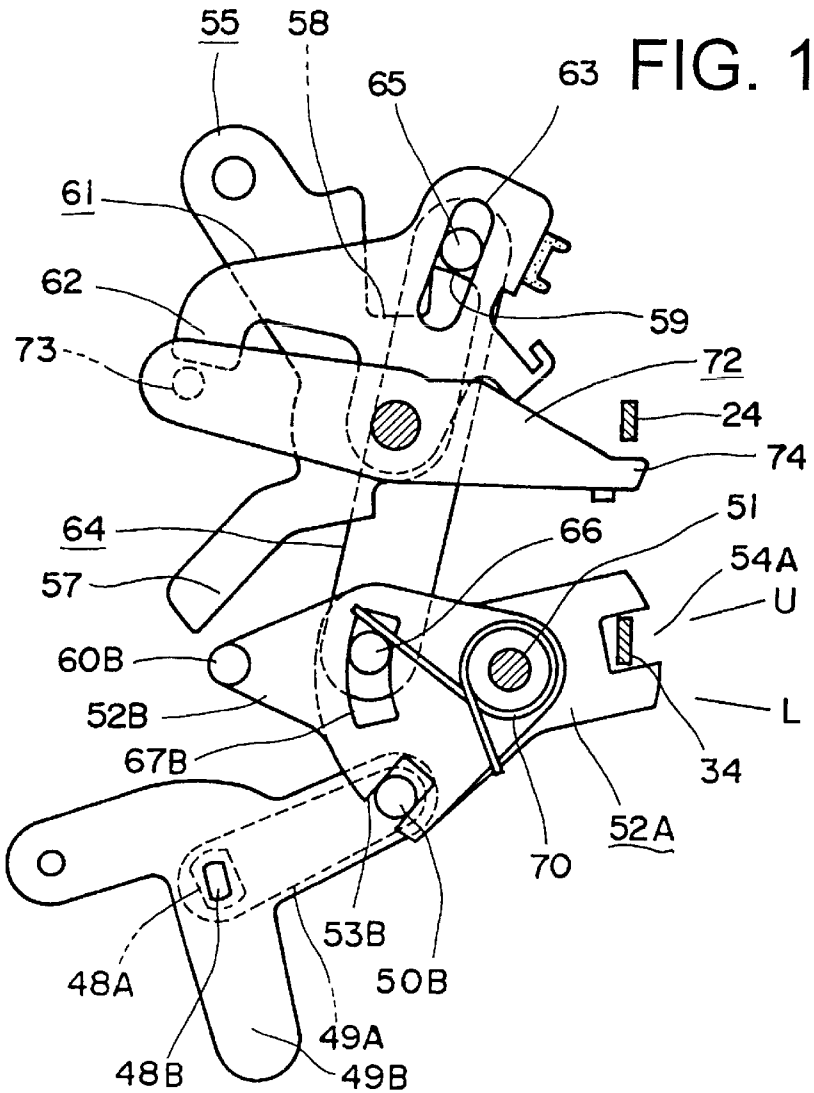
FIG. 19 is a segmentary side view of the latch assembly of the second embodiment in which the inner lever is completely rotated in the door-opening direction in FIG. 18.
Figure 20:
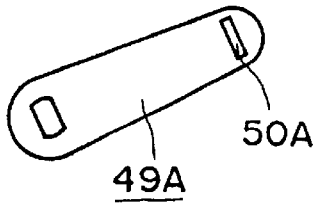
FIG. 20 is a side view of a key side lever of the latch assembly of the second embodiment.
Figure 21:
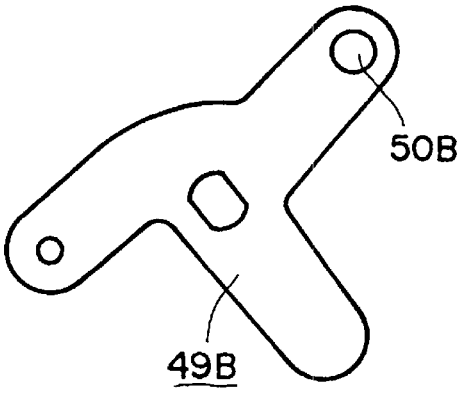
FIG. 21 is a side view of the lock button side lever of the latch assembly of the second embodiment.
Figure 22:
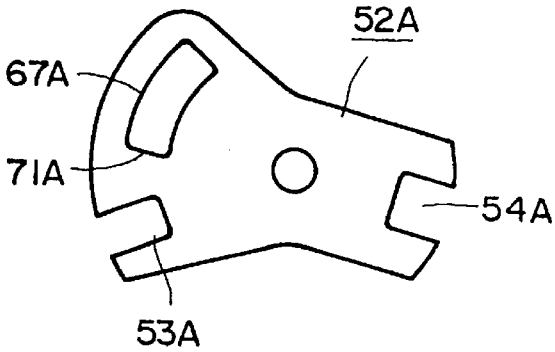
FIG. 22 is a side view of a key side operating lever of the latch assembly of the second embodiment.
Figure 23:
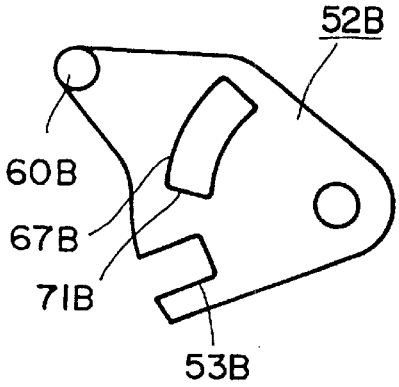
FIG. 23 is a side view of a lock button side operating lever of the latch assembly of the second embodiment.

In the state of FIG. 18, when further turning the inner lever 55 counterclockwise by the first door-opening actuation of the inside handle 28, the operating levers 52A, 52B are displaced to the unlocked position U as shown in FIG. 19 by contact of the push arm 57 with the projection 60B, but the slide pin 65 is still in contact with the blocking surface 59.

In the state of FIG. 19 where the locked state is released, when interrupting the first door-opening actuation of the inside handle 28 and restoring the inside handle 28 to the initial position, the inner lever 55 is turned clockwise, and the slide pin 65 is then released from the restriction by the blocking surface 59, and thereby the pin 65 moves downward by the elasticity of the spring 70 and enters the hook 58 as shown in FIG. 16. At this moment, the spring 70 is only elastically expanded, but it is not compressed. After being restored to the state of FIG. 16, the door can be opened by the second opening actuation of the inside open handle 28 through the engagement of the hook 58 and the slide pin 65, as mentioned above.

In the locked state of FIG. 15, when the inner lever 55 is turned counterclockwise by the first door-opening actuation of the inside open handle 28 after the anti-theft mechanism 75 has been shifted to the anti-theft state, the push arm 57 of the inner lever 55 is brought into contact with the engaging projection 60B of the button side operating lever 52B to gradually turn the operating lever 52B counterclockwise. Then, the inside lock button 36 is restored to the unlocked position by the unlocking movement of the button side lever 49B, but even if the button side shaft 48B is turned in the unlocking direction by the unlocking movement of the button side lever 49B, the anti-theft mechanism 75 does not transmit the unlocking movement of the button side shaft 48B to the key side shaft 48A. Accordingly, the key side operating lever 52A and the lock lever 34 remain held in the locked position L, and the door latch device is held in the locked state, and even if the inside open handle 28 is operated again, the door cannot be opened.

FIG. 25 shows the child-lock mechanism 76 added to the door latch device of FIG. 7. The child-lock mechanism 76 comprises an L-shaped lever 78 which is pivoted to the bent plate 22 by a shaft 77, and a child link 80 which is connected to the tip of the L-shaped lever 78 by a pin 79. The L-shaped lever 78 is formed with a control knob 81 which is projected to the outside of the door through an door-outer panel (not shown). The child link 80 is provided with a sub projection 73A alternative to the sub projection 73, and the sub lever 72 has an elongated hole 82 with which the sub projection 73A is slidably engaged. When the L-shaped lever 78 is turned by the control knob 81, the sub projection 73A is slidably shifted in the elongated hole 82 between the non-child-lock position where projection 73A is engageably opposed to the contact arm 62 of the release lever 61 and the child-lock position where the projection 73A is separated from the contact arm 62.

Advantages

As mentioned above, in the DA mechanism 27 which is the fundamental function of the present invention, the unlocking movement of the inner lever 55 by the first door-opening actuation of the inside open handle 28 is transmitted to the lock lever 34 to displace the lock lever 34 to the unlocked position U from the locked position L without passing through the slide link 64, and therefore, when the inner lever 55 is returned to the initial position after the first door-opening actuation, it is prevented to compress the spring 70 which urges the slide link 64. This improves the feeling of quality of the latch device.

What is claimed is:

1. A vehicle door latch device comprising:

an open lever for connection to an outside open handle of a vehicle door and arranged to open the door when the outside open handle is operated;

a lock lever displaceable between an unlocked position where it makes a door-opening operation of the open lever effective and a locked position where it makes the door-opening operation of the open lever ineffective;

an inner lever for connection to an inside open handle of the door, said inner lever being arranged to perform an unlocking movement from an initial position to an open position by a first door-opening actuation of the inside open handle at the time when the lock lever is in the locked position and to perform an opening movement from the initial position to the open position by a second door-opening actuation of the inside open handle at the time when the lock lever is in the unlocked position;

a release lever relevantly provided between the inner lever and the open lever for actuating the open lever when rotated;

an elongated slide link having one end operatively connected to the lock lever and displaceable between a connective position where it mechanically connects the inner lever to the release lever and a non-connective position where it disconnects the release lever from the inner lever;

a spring for urging the slide link from the non-connective position toward the connective position;

said slide link being displaced to the non-connective position against elasticity of the spring when the lock lever is displaced to the locked position and being displaced to the connective position by the elasticity of the spring when the lock lever is displaced to the unlocked position;

said inner lever having a push arm which transmits the unlocking movement of the inner lever to the lock lever without engagement with the slide link in order to displace the lock lever from the locked position to the unlocked position;

said inner lever further having a blocking surface which restrict a displacement of the slide link from the non-connective position to the connective position against the elasticity of the spring during the unlocking movement of the inner lever; and wherein a restriction by said blocking surface is released when the inner lever is returned to the initial position from the open position after the unlocking movement of the inner lever is performed, whereby the slide link is displaced into the connective position by the elasticity of the spring after the restriction by said blocking surface is released.

2. The vehicle door latch device according to claim 1, wherein no force for compressing the spring is generated when the inner lever is returned to the initial position from the open position after the unlocking movement of the inner lever is performed.

3. The vehicle door latch device according to claim 1, further comprising a slot formed on the lock lever, and a hook formed on the release lever, said slide link having a connecting pin slidably engaged with the slot and a slide pin engageable with the hook, wherein said slide link is moved in a longitudinal direction thereof to be displaced between the connective position and the non-connective position by a displacement of the lock lever, and wherein said slide link is rotated around an axis of the connecting pin as a center by the opening movement of the inner lever.

4. The vehicle door latch device according to claim 1, further comprising an anti-theft mechanism having a key side shaft connected to the lock lever and a button side shaft connected to an inside lock button of the door, said anti-theft mechanism displaceable between an anti-theft cancelled state where the key side shaft and the but ton side shaft are operatively connected with each other and an anti-theft state where an unlocking rotation of the button side shaft is not transmitted to the key side shaft, wherein said push arm of the inner lever transmits the unlocking movement of the inner lever to the lock lever through the button side shaft.

5. A vehicle door latch device comprising:

an open lever for connection to an outside open handle of a vehicle door and arranged to open the door when the outside open handle is operated;

a lock lever displaceable between an unlocked position where it makes a door-opening operation of the open lever effective and a locked position where it makes the door-opening operation of the open lever ineffective;

an actuator unit having a motor, a key side shaft connected to the lock lever, a button side shaft connected to an inside lock button of the door, and an anti-theft mechanism;

said key side shaft being arranged to displace the lock lever between the locked position and the unlocked position when rotated by the motor;

said anti-theft mechanism being displaceable between an anti-theft cancelled state where the key side shaft and the button side shaft are operatively connected with each other and an anti-theft state where an unlocking rotation of the button side shaft is not transmitted to the key side shaft;

a double action mechanism arranged to displace the lock lever from the locked position to the unlocked position without actuating the open lever by a first door-opening actuation of the inside open handle at the time when the lock lever is in the locked position, and arranged to actuate the open lever by a second door-opening actuation of the inside open handle at the time when the lock lever is in the unlocked position; and wherein said double action mechanism transmits the first door-opening actuation of the inside open handle to the lock lever through the button side and key side shafts of the anti-theft mechanism in order to displace the lock lever from the locked position to the unlocked position.

* * * * *